United States Patent [19]

Cady

[11] 4,026,057

[45] May 31, 1977

[54] SHOOTING SUPPORT FOR RIFLE

[76] Inventor: Wayne A. Cady, R.R. No. 1, Box 1864, Libby, Mont. 59923

[22] Filed: Mar. 8, 1976

[21] Appl. No.: 664,642

[52] U.S. Cl. ..... 42/94

[51] Int. Cl.[2] ..... F41C 29/00

[58] Field of Search ..... 42/94; 89/37 BA, 40 E

[56] References Cited

UNITED STATES PATENTS

| | | | |
|---|---|---|---|
| 691,912 | 1/1902 | McClean | 89/40 E |
| 2,589,039 | 3/1952 | Booth | 89/40 E |
| 2,870,683 | 1/1959 | Wilson | 42/94 |
| 3,041,938 | 7/1962 | Seabrook | 42/94 |
| 3,703,046 | 11/1972 | Barone et al. | 42/94 |
| 3,827,172 | 8/1974 | Howe | 42/94 |

*Primary Examiner*—Charles T. Jordan

[57] ABSTRACT

A mechanical support for rifle shooting providing two open top cradles to receive a rifle with the forward cradle providing compound vertical adjustment for optimum elevational positioning. The rifle support provides three point contact upon an underlying supporting surface with two support points swivelly mounted to allow simple and proper use on uneven or sloping terrain. The support is readily portable for use primarily in field shooting.

4 Claims, 6 Drawing Figures

FIG. 1
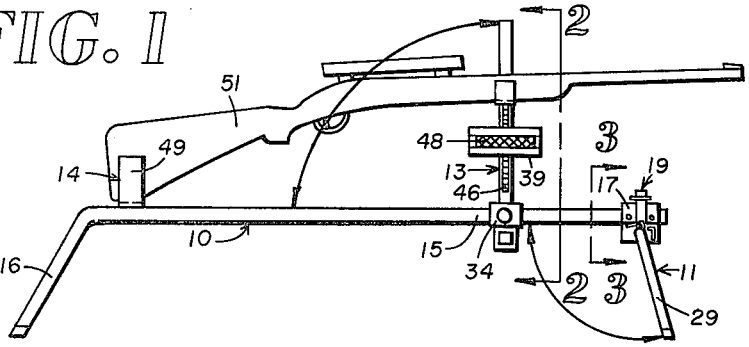
FIG. 4
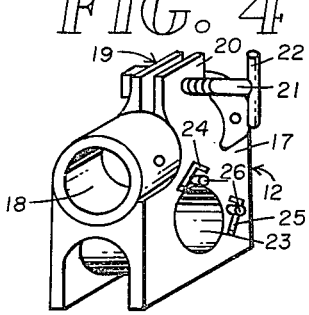
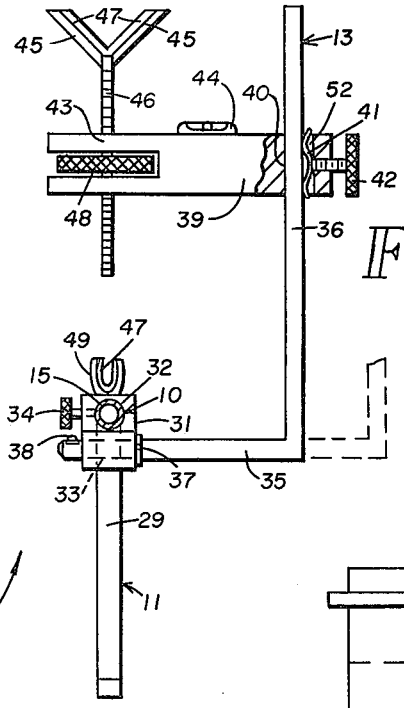
FIG. 2
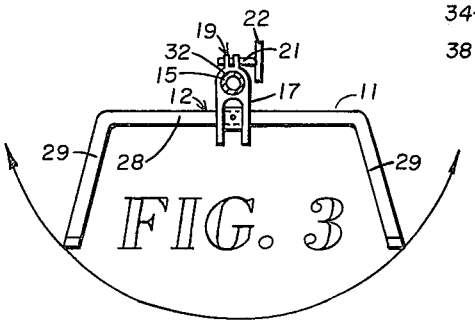
FIG. 3
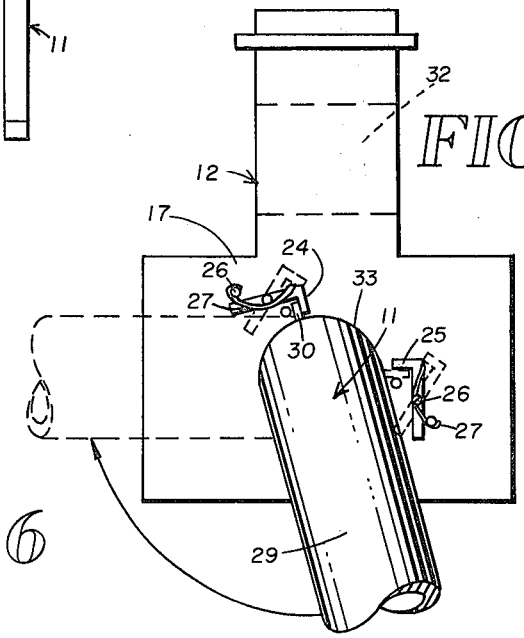
FIG. 5
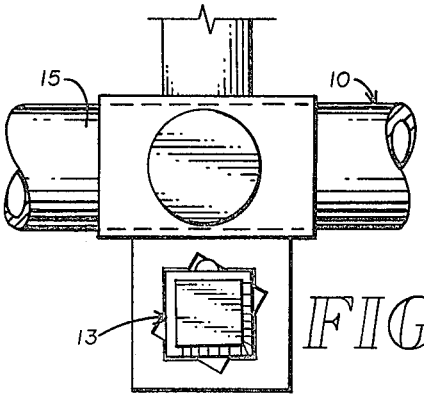
FIG. 6

SHOOTING SUPPORT FOR RIFLE

BACKGROUND OF THE INVENTION

RELATED APPLICATIONS

There are no applications related hereto now filed in this or any foreign country.

FIELD OF INVENTION

My invention relates generally to supports for firearms to aid aiming and firing and particularly to such supports that are adapted for field use and provide fine adjustment of elevation.

DESCRIPTION OF PRIOR ART

Although the rifle is designed to be held and fired by a shooter without benefit of secondary support, it has long been recognized that shooting accuracy may be enhanced by the use of a mechanical support substantially independent of the shooter, preferably one that bears the weight of the rifle and maintains it in firing position. Responsive to this knowledge, various rifle supports have become known. These various supports may be conveniently divided for consideration into a first class for use in bench rest and other target shooting and a second class adapted for field use.

In bench rest shooting where continued precise accuracy in shooting at a fixed target is of paramont importance, a stable and level surface is available on which the rifle is supported for firing. A heavy fixed, or relatively fixed, support may be utilized to secure the rifle in the desired position because in this type of shooting support cartage is no problem. Many supports of the prior art are in this class. These are generally characterized by a heavy, cumbersome support structure which has minimal vertical adjustment and substantially no azimuthal adjustment. Such supports are not well adapted for field shooting activities by reason of their bulk and lack of adjustability to accomodate varying field conditions. My invention is not designed nor intended primarily for bench shooting though it may be so used to some degree of effectiveness even if not completely so. The lack of portability of the devices of this class, however, readily distinguish them from my invention.

The second class of field supports are of a smaller, lighter nature to provide appropriate portability and commonly have provided parts that are movable relative to each other to allow folding from an assembled state into a smaller bulk to aid cartage. This compound, movable type structures has generally provided a support with substantially less rigidity and reliability than those supports commonly used in bench rest shooting and oftentimes with so little reliable supportative ability that the rest has been found substantially useless over the normal hand held or manual support. My support seeks to remedy these problems and is distinguishable over the prior art of this class in providing a readily portable structure having two point rifle support and three point support on an underlying supporting surface to provide a high degree of reliability, rigidity, and efficiency. My support allows a wide range of both elevation and azimuthal adjustment with a very fine degree of control of the elevation adjustment. The three point support of the structure on a supporting surface allows positional adjustment of one support point relative the other two to accomplish proper support on an uneven or non-horizontal supporting surface such as commonly encountered in the field. The two point rifle support is at the critical support points of the rifle and from below only to allow simple and instantaneous removal of the rifle from the support is necessary in field use. Although some of these features may be found individually in prior art devices, none of the prior art discloses all of the features combined in a single support as in my invention to provide either the structure or utility of my invention.

SUMMARY OF INVENTION

My invention provides a rigid elongate tubular body bent downwardly at one end to form a rearward leg for contact with an underlying support. The forward part of the body swivelly supports a U-shaped front leg element providing opposed depending legs in its end parts swivelly movable relative the rearward leg for convenient use on uneven or sloping ground. A vertically upward extending forward support post carries the forward cradle to support a rifle forearm. This post is adjustably mounted for longitudinal positioning on the support body so that the vertical support may be longitudinally adjusted to provide the optimum point of support for any particular rifle. A secondary cradle support arm is adjustably carried by the support post and it in turn adjustably supports the Y-shaped forward cradle extending thereabove. This combination provides two stage vertical adjustment for the forward cradle with a wide range and fine precision of adjustment. The rear cradle is carried by the body above and immediately forwardly of the rearward leg to there receive the butt portion of a rifle stock.

This structure allows a shooter to place his shoulder against the butt plate of a rifle supported in normal shooting position in my support. Since the support is designed and intended primarily for field use, at least the front leg member and post supporting the forward cradle fold toward the body to allow the rifle support to be easily and conveniently stored and transported.

A principal object of my invention is to create a novel, portable rifle support primarily for field shooting but also adaptable to bench rest shooting.

A further object of my invention is to provide such a support that may be effectively used on uneven or sloping terrain.

A further object of my invention is to provide such a support that may be readily adjusted for optimum support of any particular rifle.

A further object of my invention is to provide such a support that conveniently allows a wide range of both fine and coarse vertical adjustment of the forward support cradle to determine rifle elevation.

A still further object of my invention is to provide such a support that has open cradle-type support for a supported rifle to allow quick and simple removal of the rifle during field use.

A still further object of my invention is to provide such a device that may be used without interfering with the user's placement of his shoulder either against or near the butt plate of a rifle carried in the support to allow extremely accurate aiming.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being set forth in the accompanying drawings as is required.

BRIEF DESCRIPTION OF THE DRAWINGS

In the accompanying drawings which form a part hereof and wherein like numbers of references refer to similar parts throughout:

FIG. 1 is an orthographic side view of my invention supporting a rifle and showing particularly the various parts of my invention, their configuration and relationship.

FIG. 2 is an enlarged orthographic cross-sectional view taken on the line 2—2 of FIG. 1, in the direction of the arrows thereon, to show the details of the forward vertical adjustment mechanism.

FIG. 3 is an orthographic cross-sectional view taken on the line 3—3 of FIG. 1, in the direction of the arrows thereon, to show particularly the swivelable mounting of the forward legs on the body.

FIG. 4 is an enlarged isometric view of the swivel connector that joins the front legs to the body.

FIG. 5 is a partial, enlarged, orthographic side view of the swivel connector showing the positioning and fastening of the leg member relative thereto, especially by way of a phantom position indicated by the dotted line.

FIG. 6 is an enlarged orthographic bottom view of the forward cradle support post connector, looking upwardly to show particularly the adjustable positioning of the support post therein.

DESCRIPTION OF THE PREFERRED EMBODIMENT

Referring now to the drawings in more detail, it will be seen that my invention comprises, generally, elongate body 10 forming a leg in its rearward part and supporting forward leg element 11 in its forward part by swivelable forward leg connector 12 communicating therebetween; adjustable forward cradle 13 extends upwardly from the medial forward part of the body and rearward cradle 14 extends upwardly from the medial rearward portion of the body to cooperatively support a rifle.

Body 10 is an elongate tubular member, preferably of circular cross-section, formed with a medial-forward straight portion 15 and rear leg portion 16 down turned at an angle of approximately 60° to form the depending rearward leg. The medial-forward straight portion is of a length approximately the same as that of a rifle to be supported. The length approximately the same as that of a rifle to be supported. The length of the rear leg portion is not critical but for convenience of positioning and support is preferably about eight inches long. The tubular body is formed from some rigid durable material with relatively low density such as one of the high strength aluminum alloys to allow for ease of cartage. The cross-sectional area of the tubular element is as small as possible to provide appropriate rigidity of the structure for the same purpose.

Forward leg connector 12 is adjustably carried by the forward part of body 10 to swivelly mount forward leg element 11. This connector provides a medial body 17 defining in its upper part body channel 18 so configured as to slidably receive medial-forward straight portion 15 of body 10. Body channel 18 is defined for some distance by the connector and provides in its medial part split ring-type fastening device 19 configured with paired opposed upturned fastening ears 20 joined by screw-type tightening device 21 so that as handle 22 of that fastening device is rotated it will move fastening ears 20 further apart or closer together, depending upon the direction of motion, to cause frictional fastening of body 10 in the body channel. It is to be noted that since the connector is slidable upon the body and since the body is if circular cross-section both a rotary and sliding motion of the connector on the body may be accomplished and the connector thereafter fastened in any desired position relative to the body.

The lower portion of connector body 17 defines forward leg channel 23. This channel, again, is defined for some distance through the body in such position as to be substantially perpendicular to the body channel at a vertically spaced distance therefrom and of such configuration as to pivotably receive the forward leg element 11. Since the forward legs normally are used in only a folded or fully extended position, I regulate their positioning relative to connector 12 by at least two radially spaced catching dogs 24, 25 pivotably mounted on the connector body about the periphery of the forward leg channel on mounting posts 26 carried by the connector body. Each of these catching dogs is an L shaped element, as illustrated particularly in FIG. 5, mounted on posts 26 as a bell-crank and biased by springs 27 to an inward position to operatively engage associated catching pins 30 carried by the forward leg element.

Forward leg element 11 is a U-shaped structure having medial body portion 28 with opposed ends turned downwardly through a nearly vertical angle to form two opposed forward legs 29. The forward leg element is formed of a cylindrical tubular element substantially similar to that from which body 10 is formed and opposed forward legs 29 are of substantially the same length as rearward leg 16 of the body, so that when the three legs support the structure on a planar surface the medial-forward straight portion 15 of body 10 is substantially parallel to that planar surface.

At least one positioning pin 30 is provided in medial body portion 28 of the forward leg element on at least one side of forward leg connector 12 to cooperate with catching dogs 24, 25 carried by that connector to position the leg element relative thereto. Normally in two positional positioning only one catcher pin will be required; it is mounted in the leg element so that in the forward rotatable position the legs extend slightly forwardly of the vertical as illustrated in FIG. 1 and in the folded position the legs fold backwardly so that a plane through them would be substantially parallel to the medial-forward straight portion 15 of body 10. Plural positioning pins may be provided on each side of the forward leg connector, if desired, to maintain lateral positioning of the forward leg element relative thereto.

Forward cradle structure 13 provides a compound adjustable vertical support adjustably carried on body 10 to support a forward rifle supporting cradle at a pre-determined distance above the body. The forward support connector 31 provides a body defining upper elongate body channel 32 configured to slidably receive medial-forward straight portion 15 of the body 10 and lower vertical support arm channel 33 extending perpendicularly to the body channel and configured to slidably receive the vertical support arm. Headed fastening screw 34 is threadedly engaged through connector body 31 to communicate with the body channel to provide means of adjustably fastening the connector upon the body element by appropriate screwing manipulation.

The vertical support arm is formed from an elongate rod of square cross-section to the L shaped illustrated particularly in FIG. 2, with lower horizontal arm 35 and a longer vertical arm 36. The end part of the lower horizontal arm is provided with boss-type collar 37 at a spaced distance inwardly the end of the arm and locking ball 38 spring biased to an outward position but manually movable inwardly and so positioned that when the arm is carried in body channel 32 the boss will be on one side of the connector and the locking ball on the other to positionally maintain the vertical support in the connector. It is to be noted that the square shape of the vertical support and of its channel in the connector prevent arm from pivotably moving relative the connector, if desired, plural channels may be provided to allow a more compact positioning of the vertical support arm for cartage or storage.

Horizontal secondary cradle support arm 39 is an elongate structure as illustrated particularly in FIG. 2. It has its principal areal cross-section in a horizontal plane and defines in the first end part vertical support channel 40 configured to slidably receive the longer upright vertical arm of the vertical support. The vertical support channel is preferably enlarged in one portion to form keyway 52 to carry leaf spring 41 which is positionally maintained under some stress so that the spring's bias creates a frictional force between the secondary cradle support arm and the vertical support arm. Headed fastening screw 42 is threadedly engaged through the cradle support arm to extend into the spring channel so that by appropriate screwing manipulation the screw may be tightened against 41 to adjust the tension therein and consequently the friction between the cradle support arm and the vertical support. The second end part of the cradle support arm is formed with the U-shape illustrated in FIG. 2 with adjustment screw channel 43 defined in the support arm body between vertically spaced portions thereof. The adjustment screw channel is appropriately configured to operatively receive an appropriate adjustment screw disc 48. A vertical, medially positioned cradle adjustment screw hole is provided in the medial part of the channel defining portions of the cradle support arm to slidably receive a cradle adjustment screw 46.

Bubble level device 44 may be provided for convenience on the cradle support arm to aid a shooter in determining the level or degree of tilt in the device when in use, but this level device is not a necessary part of my invention.

The forward support cradle provides a Y-shaped structure, illustrated in FIG. 2, formed with angularly related, opposed cooperating cradle arms 45 of some areal extent structurally communicating with each other and with the depending threaded cradle adjustment screw 46. The inner surfaces of cradle arms 45 are preferably, but not necessarily, provided with some reasonably soft, resilient material 47 to cushion a gun positioned therein so as to avoid physical damage thereto and provide adequate support thereof over some appreciable area. Threaded cradle adjustment screw 46 is configured to be slidably supported in adjustment screw channel 43 of the cradle support arm 39 and is threadedly engageable within a threaded medial hole in adjustment disc 48. This adjustment disc is so sized as to be nicely carried in a rotatable fit within adjustment screw channel 43 of the horizontal cradle support arm. As the adjustment screw is rotatably turned relative to the support arm the cradle adjustment screw moves upwardly or downwardly in response to the rotary motion of the vertically restrained adjustment disc.

With the foregoing arrangement of parts of the forward cradle member, it is to be noted that the entire member may be moved lineally along body 10 of my device and at the same time the cradle may be moved vertically relative to the body in compound fashion coarsely by manually moving the secondary cradle support arm and fastening it by means of screw 42 and secondarily and finely by means of screw motion of adjustment disc 48.

Rearward cradle 14 provides two angularly related, cooperating opposed cradle arms 49, each structurally communicating with the other and both structurally communicating with the upper portion of the rearward medial part of body 10 of my invention. Again, cradle arms 49 are lined on their inner adjacent surfaces with some resilient lining 47 as in the case of the forward cradle. The rearward cradle is shaped similarly to the forward cradle and of appropriate cross-sectional configuration to reasonably well support the butt of a gun to be carried therein. It generally is not necessary that the rearward cradle be positionally adjustable relative to body 10, since any required adjustment may be accomplished by reason of the other adjustable features of my invention and particularly the forward cradle support.

Having thusly described my invention, its operation may now be understood:

Firstly, my device is formed and assembled according to the foregoing specification and as illustrated particularly in FIG. 1 of the drawings. The invention is positioned on a supporting a surface such as the earth (not shown) so that when in supported position my rifle support has the vertical cradle mechanism extending substantially vertically and a substantially vertical plane through the rearward and forward rifle supports passes through the desired point of aim of a supported rifle. In accomplishing such positioning it is to be noted that the azimuthal alignment of the support may be readily accomplished by positioning the forward legs on a support and moving the rearward leg relative thereto. It is to be further noted that if the three points of support for the device are not co-planar, the forward legs and their connector may be pivotably moved relative to body 10 to accomplish the specified alignments.

In this condition the rifle 51 to be supported is placed from above in the open top forward and rearward cradles, as illustrated, with the butt of the rifle resting substantially in the rearward cradle and the forward cradle mechanism moved longitudinally along body 10 to the point of optimum support of the rifle forearm. Prior art discloses much theory concerning determination of the optimum point of support of the forearm of a rifle and this point may be readily determined with reference thereto. In general, however, in ordinary bolt action rifle construction where the forearm is bolted to a fastening lug on the barrel of a rifle forwardly of its chamber, the point of optimum support is substantially vertically below the bolt fastening the forearm to the rifle barrel. This may vary, however, in particular rifles and with differing rifle constructions. Where ever such point be, however, it must be somewhere between the butt and forward end of the forearm of the rifle and my forward cradle can be positioned anywhere within these limits.

After the positioning of the rifle as aforesaid any final azimuthal adjustment of the support is made by physically moving the support as hereinbefore provided. The ultimate alignment is accomplished by the users use of the rifle sights. After azimuthal alignment the vertical alignment or elevation is adjusted, firstly, coarsely by manually moving the secondary cradle support arm on the vertical support arm and secondarily, and finely by moving the forward cradle support relative the secondary cradle support arm by appropriate screwing adjustment of adjustment disc 48. In this position, then, the rifle is in final firing position and firing may be accomplished in the normal fashion.

From the foregoing description it is to be particularly noted that if desired a rifle to be fired may be supported at all times prior to firing entirely by my support without any requirement that it be supported by any part of the body of the shooter and particularly by his shoulder. This allows a rigid mechanical support of the weapon entirely independent of the shooter and uninfluenced by him except as to what slight force may be exerted upon the rifle in pulling the trigger for firing. If recoil of a particular rifle be a problem, the shooter's should may be positioned immediately behind the rifle to stop this motion shortly after its inception but yet the shoulder need not touch the rifle prior to shooting. At the same time, if it be desired that the rifle be supported on the shoulder this again may be fairly readily accomplished by appropriate, simple and common manipulations of the shooter's body.

It is further to be noted that my invention may be formed of relatively light metal of appropriate rigidity and physical strength and when so formed its mass is relatively low to allow simple and easy cartage. This ease of cartage and additional ease of storability are further enhanced by the foldable features of my invention.

The means of adjustably fastening the various parts of my invention relative to each other are obvious matters of choice and undoubtedly other fastening means of the prior art that are of a similar nature and type may be used with my invention.

Having thusly described my invention, what I desire to protect by Letters Patent, and what I claim is:

1. A rifle support comprising, in combination an elongate body having a straight medial-forward portion and a rearward portion downturned to form a rear leg;

a U-shaped forward leg element having downturned end portions forming opposed cooperating front legs adjustably swivelly mounted by a forward leg connector upon the forward part of the body;

a forward cradle structure adjustably supported by the medial part of the straight body portion at a spaced distance thereabove and adjustably movable by manual manipulation to pre-determined positions along said body and vertically thereabove; and a rearward cradle carried by the rearward portion of the body at a spaced distance thereabove.

2. The rifle support of claim 1 wherein the forward and rearward cradles comprise open topped padded cradle elements to allow ease of placement or removal of a rifle therefrom.

3. The invention of claim 1 wherein the forward cradle is adjustable movable toward the body and the forward legs are adjustably pivotably movable rearwardly from their supportative position to provide a more compact structure for ease of cartage.

4. The invention of claim 1 wherein the forward cradle structure is further characterized by:

a forward cradle vertical support connector, slidably carried for adjustable positioning upon the body, carrying an upwardly extending vertical support which in turn adjustably carries for pre-determined vertical positioning a secondary horizontal cradle arm extending horizontally therefrom; and a forward cradle adjustably carried at a spaced distance above the secondary cradle support arm by a cradle adjustment screw threadedly carried in an adjustment disc rotatably supported by the secondary cradle support arm for fine screw-type vertical adjustment of the forward cradle relative to the secondary cradle support arm.

* * * * *